US011378312B2

(12) United States Patent
Preston et al.

(10) Patent No.: US 11,378,312 B2
(45) Date of Patent: Jul. 5, 2022

(54) REFRIGERATION CHILLER OR COOLER SYSTEM WITH SELF-CLEANING FILTER

(71) Applicants: Philip Preston, Northfield, IL (US); Thomas P. Wallbaum, Mt. Prospect, IL (US)

(72) Inventors: Philip Preston, Northfield, IL (US); Thomas P. Wallbaum, Mt. Prospect, IL (US)

(73) Assignee: Preston Industries, Inc., Niles, IL (US)

( * ) Notice: Subject to any disclaimer, the term of this patent is extended or adjusted under 35 U.S.C. 154(b) by 0 days.

(21) Appl. No.: 15/436,424

(22) Filed: Feb. 17, 2017

(65) Prior Publication Data

US 2018/0238616 A1 Aug. 23, 2018

(51) Int. Cl.

| | |
|---|---|
| ***F25B 47/00*** | (2006.01) |
| ***F25B 25/00*** | (2006.01) |
| ***F25B 39/04*** | (2006.01) |

(52) U.S. Cl.

CPC ..... *F25B 47/00* (2013.01); *F25B 25/005* (2013.01); *F25B 39/04* (2013.01); *F25B 2700/21151* (2013.01); *F25B 2700/21152* (2013.01); *F25B 2700/21172* (2013.01); *F25B 2700/21173* (2013.01)

(58) Field of Classification Search

CPC ..... B01D 46/00; B01D 46/18; B01D 46/185; B01D 46/20; B01D 46/46; B01D 46/52; B01D 46/521; F24F 13/28; F24F 11/30; F24F 11/39; F25B 2700/21161; F25B 2700/15; F25B 2700/21171; F25B 47/00; F25B 2700/21173; F25B 2700/21152; F25B 2700/1933; F25B 2500/19; F25B 2700/21151; G01M 99/008; G01M 99/002

See application file for complete search history.

(56) References Cited

U.S. PATENT DOCUMENTS

| | | | | |
|---|---|---|---|---|
| 2,848,064 A * | 8/1958 | Gregory | ..... | B01D 46/18 160/241 |
| 4,221,576 A | 9/1980 | Phillips, Jr. | | |
| 5,217,513 A * | 6/1993 | Armbruster | ..... | B01D 46/18 55/351 |
| 5,809,795 A | 9/1998 | Beaverson | | |
| 2006/0070527 A1 * | 4/2006 | Chapman | ..... | B01D 46/22 96/417 |

(Continued)

FOREIGN PATENT DOCUMENTS

| | | | | |
|---|---|---|---|---|
| CN | 1035211010 A | 1/2014 | | |
| JP | H116679 A * | 1/1999 | ..... | F25D 19/00 |
| JP | H116679 A | 1/1999 | | |

(Continued)

OTHER PUBLICATIONS

Engineering ToolBox, Fan Affinity Laws, 2003 (Year: 2003).*
International Search Report dated Apr. 30, 2018.
PCT Preliminary Report on Patentability dated Aug. 29, 2019.

*Primary Examiner* — Larry L Furdge
*Assistant Examiner* — Chang H Park
(74) *Attorney, Agent, or Firm* — Vitale, Vickrey, Niro & Gasey LLP

(57) ABSTRACT

An automatic and dynamic filter window for the air inlet to a chiller or cooler is disclosed, including a controller and a scrolling filter for replacing filters prior to clogging or contamination that may compromise the operation of the chiller.

12 Claims, 5 Drawing Sheets

(56) References Cited

U.S. PATENT DOCUMENTS

| | | | | |
|---|---|---|---|---|
| 2010/0077923 | A1* | 4/2010 | Lewis | B01D 46/0023 96/18 |
| 2012/0318073 | A1* | 12/2012 | Zavodny | B01D 46/0086 73/862.581 |

FOREIGN PATENT DOCUMENTS

| | | | | |
|---|---|---|---|---|
| KR | 20130075614 | A * | 7/2013 | F24F 11/04 |
| KR | 101752664 | B1 | 6/2017 | |

* cited by examiner

REFRIGERATION CHILLER OR COOLER SYSTEM WITH SELF-CLEANING FILTER

FIELD OF THE DISCLOSURE

The present disclosure relates generally to a self-regulating and actuating filter for chiller or cooler systems. More specifically, the present disclosure is directed towards a system for a self-cleaning filter for an air inlet to a condenser or air-cooled heat exchanger, including a scrolling mechanism which receives an input from a controller to shift a filter scroll in order to create a dynamic filter window for the air inlet.

BACKGROUND OF THE INVENTION

Chillers and Coolers have developed as a proven technology over several decades in a variety of end-user and OEM applications ranging from lasers and analytical equipment to reactors and manufacturing equipment. Specifically, such devices provide stable and reliable cooling for many common heat removal applications, including laser etching, AA furnaces, ICP, rotary evaporators, vacuum systems, reaction vessels, plasma etching, and condenser cooling, among others.

One challenge, however, is the expenses attendant with the use of chilling and cooling equipment, coupled with the lack of task specific expertise needed for the efficient maintenance of such equipment. Certain expensive components—such as a compressor—can break down requiring expensive repair or replacement. However, the applicants have found that a significant portion of chillers and coolers sent in for service are not, in fact, in need of repair. Rather, the chiller units have simply shut down or degraded in performance as a result of dirty or clogged filters. Indeed, Applicant's anecdotal experience to date has been that over 20% of chillers and coolers being returned for servicing show no problem in the mechanical performance of the system. As a result, the chillers and coolers are taken off line unnecessarily, creating undue cost and disruption for manufacturer and end user alike.

Currently, there exist conventional, manual mechanisms for changing compressor filters. Such equipment usually requires a level of knowledge that may make some end users uncomfortable or reluctant to undertake the necessary service. Even worse, as human nature is more reactive to the care of such equipment, such self-service will not occur as frequently as needed, and may only occur after the malfunction or degradation in performance of the chiller or cooler. As a result, any servicing occurring as a result of untimely filter changing may require chiller or cooler redundancy, which make not be economically feasible, or downtime, creating economic upheaval for the end user. Moreover, the inability to handle service requirements prior to malfunction or degraded performance may impact the effective lifespan of the chiller or cooler, with resulting increases in capital expenditures for the end user.

In addition, certain aspects of chillers may be able to compensate for potential degradation of the system that would not necessarily be perceptible by existing monitoring systems for determining whether a filter change may be needed. For instance, the preferred embodiment of the chiller system of the present invention incorporates a variable speed fan working off of direct current power. That is, the system may be compensating for a clogged or obstructed filter by increasing draw from the fan, creating a system which would not promptly detect filter obstruction in the event of, for instance, the detection of irregular sensor inputs from the system.

To date, there are no chiller or cooler products which provide an automated dynamic filter window for the air inlet to delay or avoid potential malfunction or degradation.

What is needed is a chiller or a cooler with an automatic and dynamic filter window for removing and replacing filters that may otherwise become blocked, thereby delaying or avoiding potential operational problems with such equipment. In addition, what is needed is a chiller or a cooler with a more sophisticated detection system to respond to a variety of potential signals for indicating that a filter has become blocked.

Definition of Terms

The following terms are used in the claims of the patent as filed and are intended to have their broadest plain and ordinary meaning consistent with the requirements of the law:

A chiller is a machine that removes heat from a liquid via a vapor-compression or absorption refrigeration cycle. A cooler is a machine that removes heat from a liquid via a liquid-to-air heat exchanger. Both are used in industrial and laboratory applications, among other things.

A filter sheet is a component or portion of a scroll or similar larger filter material which may be moved into position near the air intake surface of the chiller or cooler so as to reduce or eliminate particulate from the air flow into the heat exchanger.

Where alternative meanings are possible, the broadest meaning is intended. All words used in the claims set forth below are intended to be used in the normal, customary usage of grammar and the English language.

SUMMARY OF THE INVENTION

The present invention relates to one or more of the following objects, features, elements or combinations thereof.

Thus, it can be seen that one object of the disclosed invention is to provide a chiller or cooler with an integrated and automatically actuated scrolling filter for avoiding unnecessary shut downs of the chiller or cooler system.

A further object of the present invention is to provide a chiller or cooler assembly with the ability to periodically and automatically change filters to achieve longer operational lifetime of the assemblies and sustained operational efficiency.

Still another object of the present invention is to provide a chiller or cooler with a filter changing mechanism that is automated and does not require inspection by a service technician.

Yet another object of the present invention is to provide a chiller or cooler with a filter changing mechanism that can respond to a variety of operating parameters, including but not limited to fan speed and temperature output to determine if a filter change is desirable.

An additional object of the present invention is to provide a chiller or cooler with an integrated filter changing mechanism and self-test mechanism with the ability to eliminate "false positives" of the need for service of the chiller or cooler.

It should be noted that not every embodiment of the claimed invention will accomplish each of the objects of the invention set forth above. For instance, certain claimed embodiments of the invention may focus only on time actuated automatic filter changing functions. Further objects of the invention will become apparent based upon the summary of the invention, the detailed description of preferred embodiments, and as illustrated in the accompanying drawings. Such objects, features, and advantages of the present invention will become more apparent in light of the following detailed description of various preferred embodiments thereof, and as illustrated in the accompanying drawings.

DETAILED DESCRIPTION OF EMBODIMENTS OF THE INVENTION

Figure 1:
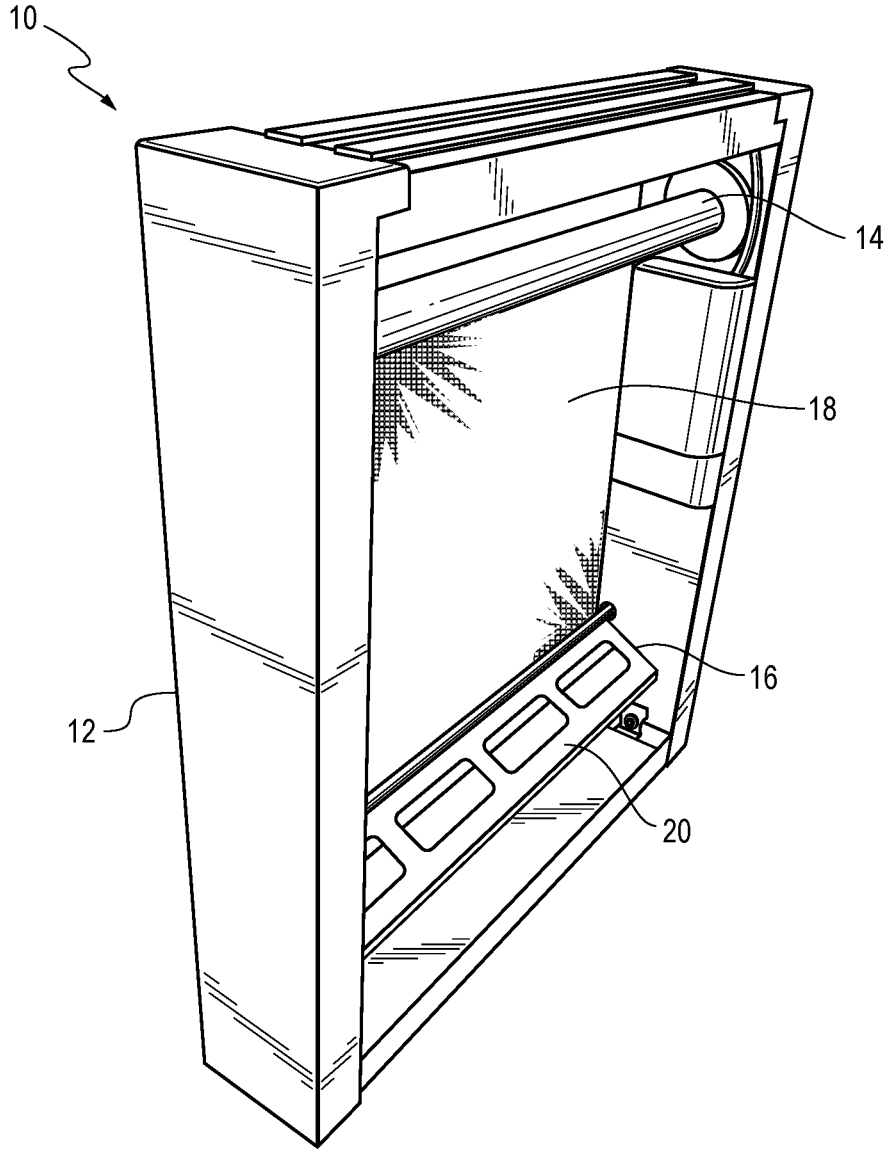
FIG. 1 is a perspective figure of a self-cleaning filter assembly in accord with a first preferred embodiment of the present invention.
Figure 2A:
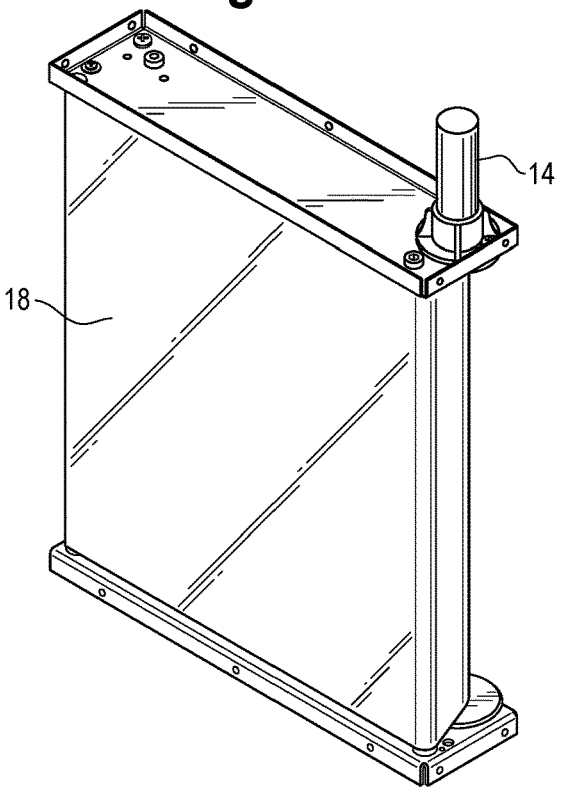
FIGS. 2*a-e* are perspective front, perspective back, front, side and top views, respectively of a second preferred embodiment of the present invention.
Figure 2B:
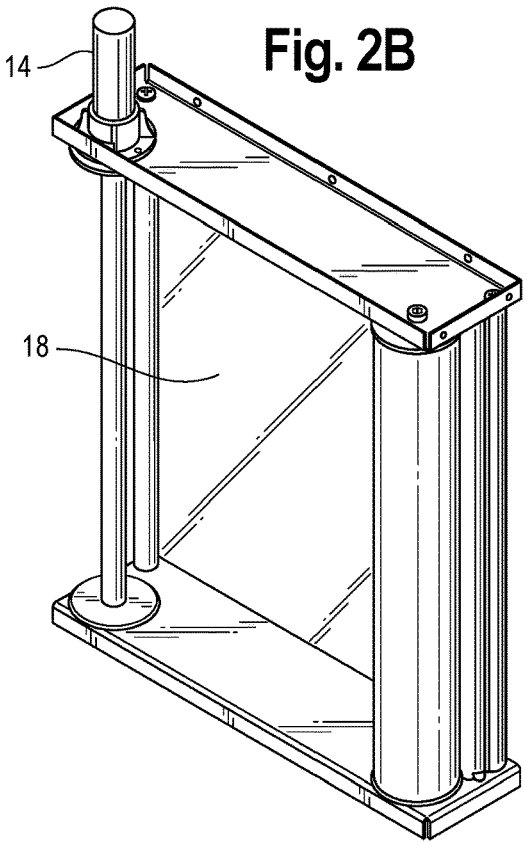
Figure 2C:
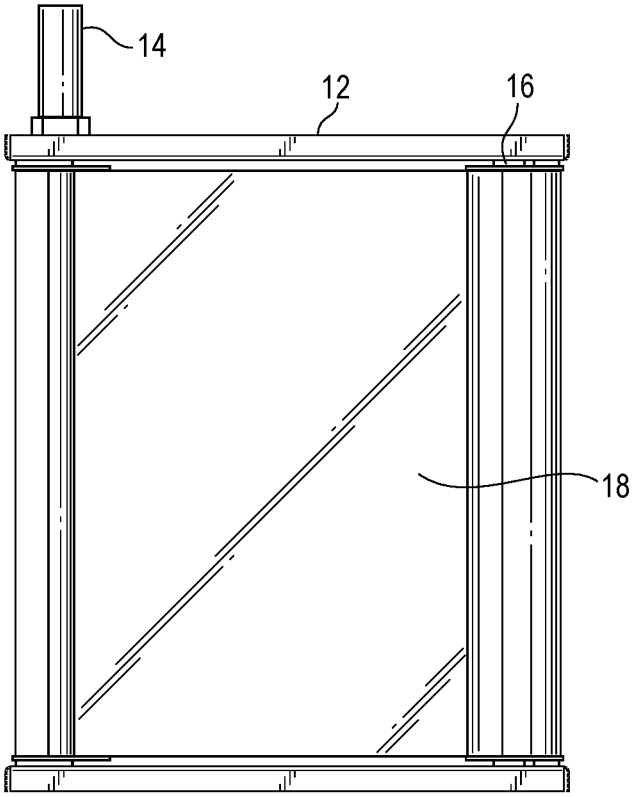
Figure 2D:
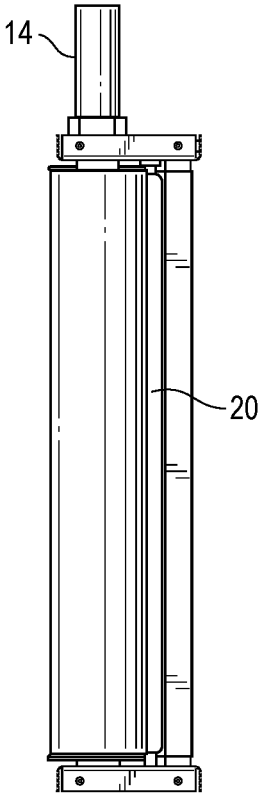
Figure 2E:
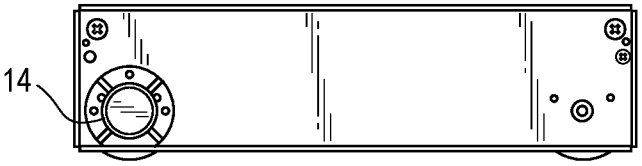

As can be seen in FIG. 1, the present invention comprises filter assembly 10 for supplying a filtered air stream to a chiller or similar device (not shown). The filter assembly 10 includes the basic components of a frame 12, a top spindle 14, a bottom spindle 16, a scrolling filter 18 and a tension control 20. In this embodiment, the scrolling filter 18 is preferably a spunbonded polyester fiber filter media such as Reemay 2150 sold by Midwest Filtration LLC. The filter 18 is initially wound around the bottom spindle 16 and the top spindle 14 is connected to a control unit 60 (not shown) and a motor and motor assembly (not shown) for pulling the filter 18 in a bottom to top direction, while a tension control 20 keeps the filter 18 taut to as to avoid having the filter becoming snagged on any components of the chiller or cooler system due to the suction of the air flowing into the system. Finally, the frame 12 of this embodiment is designed to be modular so as to enable the removal of the entire assembly 10 when the supply of the scrolling filter 18 has been exhausted.

An alternative embodiment of the present invention is shown in FIGS. 2*a-e*. This embodiment is functionally similar to that shown in FIG. 1, with the exceptions that the assembly does not have a frame 12 that is a part of the chiller or cooler (i.e., not a removable, modular frame), and the spindles 14, 16 are oriented so as to move the scrolling filter 18 in a left to right or other direction instead of the "down to up" scrolling direction shown in FIG. 1.

Figure 3:
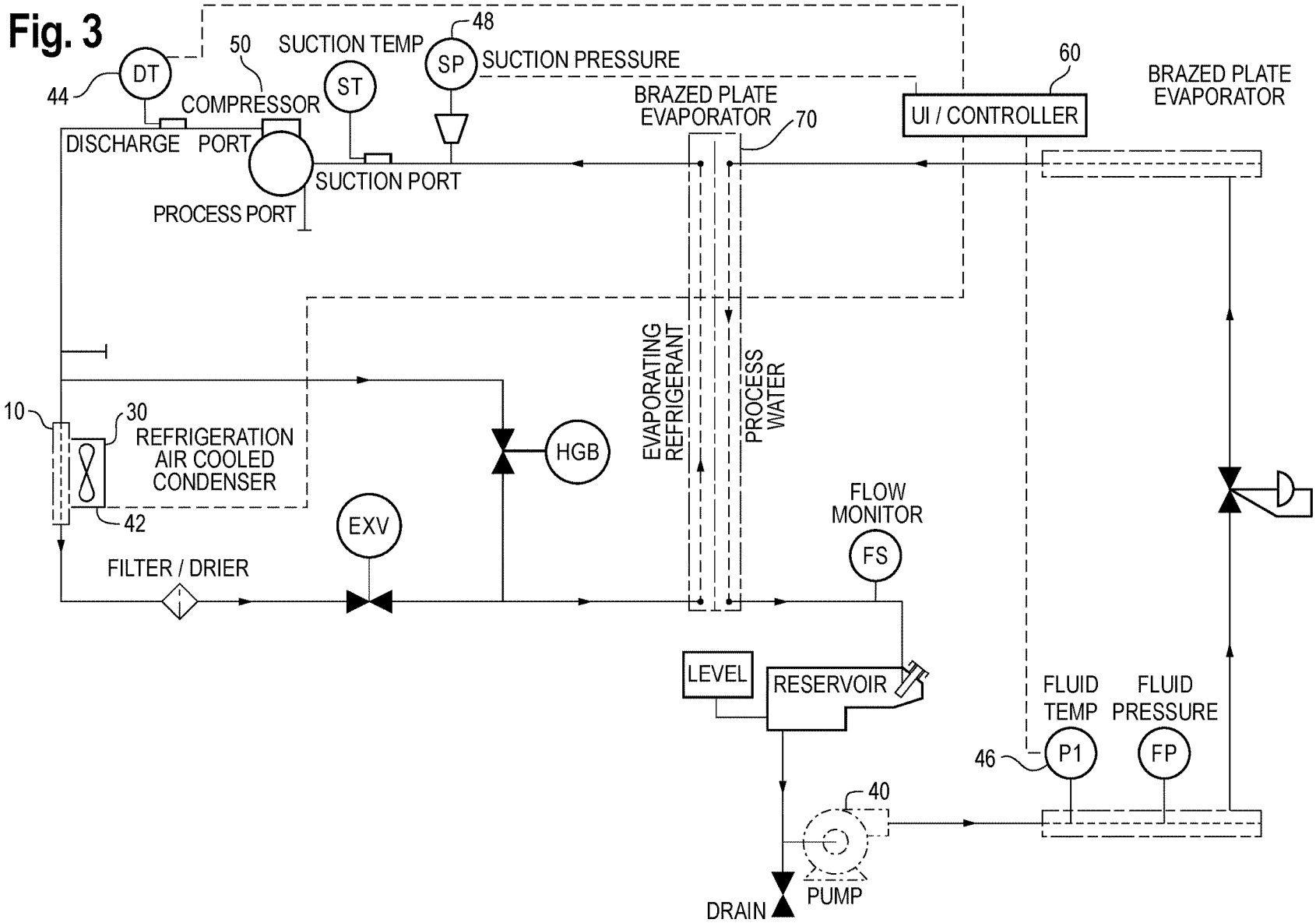
FIG. 3 is a schematic showing a mechanical assembly of a chiller relative to the filter assembly of the present invention.
Figure 4:
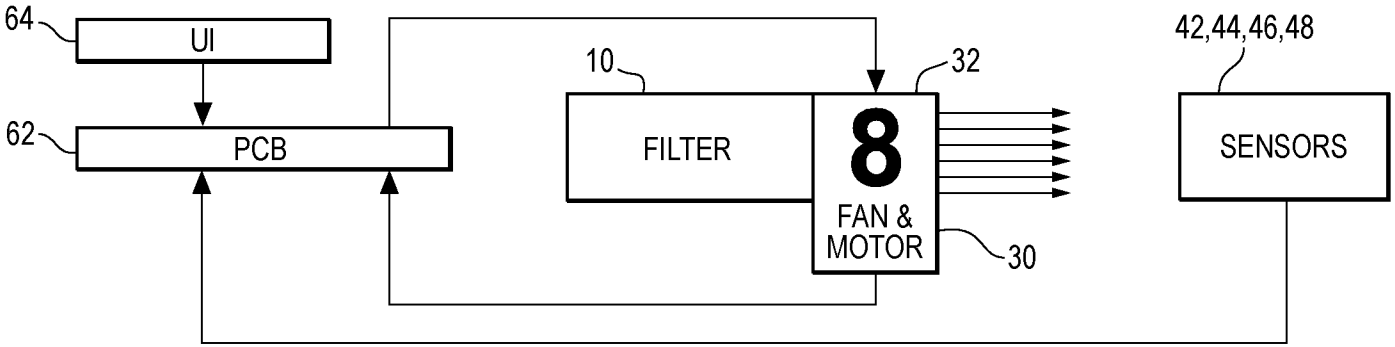
FIG. 4 is a schematic showing an electrical assembly of the control unit and sensors of a chiller system relative to the filter assembly of the present invention.

The schematics showing the interaction of the filter subassembly 10 with the rest of the chiller or cooler assembly is shown in FIGS. 3 and 4. Turning to FIG. 3, the filter assembly 10 is proximate to the condenser subassembly 30, which includes an air intake fan and motor 32 for drawing in a fresh air supply for the condenser. The chiller system in this preferred embodiment includes a compressor 50 for the closed loop refrigerant portion of the system, wherein the refrigerant chills the process water side of the chiller assembly through a countercurrent heat exchange in the evaporator 70. The chilled process water is then circulated by pump 40 to the equipment being chilled. The entire chiller system is controlled by a controller unit 60, which includes a controller/microprocessor 62 and a user interface 64. In its simplest form, the microprocessor can be electrically connected and responsive to a sensor 42 connected to the motor and fan 32 and programmed to send a signal actuating the top spindle 16 and thereby scrolling the filter 18 so as to create a new "clean" window for receiving fresh air flow after a preselected period of operating time for the motor and fan 32 (e.g., automatically actuating for every X hours that the motor and fan 32 is on).

Still other existing operational sensors, such as compressor discharge temperature sensor 44 and compressor suction sensor 48, could provide inputs to the controller 62 to actuate the scrolling of the filter 18. That is, the compressor discharge temperature 44 could indicate a temperature that exceeds a preselected limit that is stored in the controller 62 which could be indicative of a compromised functionality of the filter subassembly 10. In order to eliminate a simple filter change as a possible problem, the controller could then actuate the scrolling of the top spindle 16 so as to change the window of the filter 18.

Alternatively, the control unit 60 can be responsive to other inputs and or sensors, such as the user interface 64. For instance, if the operator may actuate a self-test sequence such as is described in Applicant's co-pending application "Self-Test System For Qualifying Refrigeration Chiller System Performance" (U.S. Pat. No. 10,684,616), the contents of which are incorporated herein by reference. Upon the user initiating a self-test operation (e.g., pressing a "self-test" button), the chiller instructs itself to follow certain preprogrammed temperature set points autonomously. The chiller is reconfigured (by fluid hose lines so as to connect the inlet and outlet ports to one another directly) by end user to perform an automatic self-test characterization of the users Chiller at install locale/operation site. By connecting the inlet to the outlet, (i.e., fluid supply and return lines) connection points at the instrument, chiller then instructed to automatically operate a specific sequence of system operations. Measurements from such system operations are internally derived to the chiller and compared to the signature of measurements recorded at the time of manufacture, while altering or adjusting such manufacturing measurements to account for differences from in situ operating parameters (e.g., differences between the operational ambient air temperature and the temperature as of manufacture). Differences between these two groups of measurements (e.g., differences between the adjusted manufacturing measurement and the in situ measurements beyond a predefined threshold) are used to determine chiller degradation and/or predict the need for servicing. As a result of these comparisons, the self-test mechanism presents to the self-test mechanism presents to the user and/or the manufacturer a performance indication and/or indication that corrective action is required. In such an instance, an operator can actuate a self-test through a soft key or similar input via the user interface 64, which in turn causes the top spindle to actuate immediately, thereby eliminating a clogged filter 18 from creating an incorrect or false indication of equipment failure. Similarly, the filter 18 could be actuated from the user interact 18 through a simple manual override button, separate and apart from any self-test mechanism.

Yet other alternative examples can be used for one or more existing sensors to provide inputs to the controller 62 to actuate the scrolling of filter 18. For instance, the sensor input 46 can be a temperature output sensor for the chilled water output by pump 40. That is, if the temperature 40 exceeds a preselected limit when the fan and motor 32 are running, the controller can automatically actuate the spindle 16 to scroll the filter 18. Still another alternative could include a sensor on the fan and motor 32 to sense the RPMs of the fan in operation. That is, since the most preferred embodiments of the industrial chillers of the present invention work with fans having variable speed and a direct current power supply, the sensor of the present invention could note compare the power input to the fan with a preselected power limit programmed in the controller 62.

If the current input to the fan exceeds a preselected limit for a given period of time (i.e., thus suggesting that the fan is having to exceed the preselected current limit because of a clogged filter), the controller would then send an actuation signal to the bottom spindle 16 so as to scroll the filter 18.

While the disclosure is susceptible to various modifications and alternative forms, specific exemplary embodiments thereof have been shown by way of example in the drawings and have herein been described in detail. It should be understood, For instance, there is a number of variants in terms of which operating parameters can be sampled in order to actuate the scrolling filter 18 (e.g., operation time, discharge temperature, fan speed, etc.), and there is no intent to limit the disclosure to the particular embodiments disclosed, but on the contrary, the intention is to cover all modifications, equivalents, and alternatives falling within the spirit and scope of the disclosure as defined by the appended claims.

What is claimed is:

1. A system for automatically maintaining an efficacious filter for an intake to a condenser in a chiller or cooler having a condenser and a compressor, the system comprising;

a) a filter sheet including a portion of the filter sheet so as to provide a dynamic window for operatively engaging an air intake surface to the condenser;

b) a spindle for moving the dynamic window;

c) a controller for automatically engaging the spindle to move the filter sheet so as to shift the portion of the filter sheet operatively engaging the air intake surface, the controller further generating a self-test signal to the chiller to change a set point of temperature of the chiller a preselected amount, the controller further connected to a fluid temperature sensor to determine a self test cooling rate for the chiller to obtain the change in the set point of temperature, the controller further calculating an expected self test cooling rate using an ambient air temperature and a factory self test cooling rate stored in memory, and the controller further comparing the self test cooling rate and the expected self test cooling rate and automatically engaging the spindle when the self test cooling rate and the expected self test cooling rate deviate by more than a preselected threshold; and d) a plurality of sensors connected to the controller, wherein one of the plurality of sensors connected to the controller, each of the plurality of sensors for providing independent inputs wherein the inputs of each of the plurality of sensors are compared against a corresponding fixed, preset limit programmed into the controller for causing the controller to automatically engage the spindle, wherein at least one of the plurality of sensors is the fluid temperature sensor which measures a liquid temperature of a liquid being cooled, and another of the plurality of sensors measures an operating parameter of a fan within the chiller or cooler.

2. The system of claim 1, wherein the controller automatically engages the spindle so as to shift the filter sheet in response to a preset time interval.

3. The system of claim 1, further comprising at least one of the plurality of sensors connected to the controller, wherein the controller automatically engages the spindle in response to a sensor input greater than a fixed preset limit corresponding to an operating parameter of the fan, the compressor or the condenser.

4. The system of claim 1, wherein the plurality of sensors includes the fluid temperature sensor which measures a chilled water output temperature sensor.

5. The system of claim 1, wherein the plurality of sensors includes a fan current sensor.

6. The system of claim 1, wherein the plurality of sensors includes a discharge temperature sensor.

7. The system of claim 1, wherein the plurality of sensors includes an RPM fan sensor.

8. A system for automatically maintaining an efficacious filter for an intake to a condenser in a chiller or cooler comprising;

a) a filter sheet having a dynamic window for operatively engaging a condenser intake surface;

b) a spindle for moving the dynamic window;

c) a plurality of sensor inputs from a plurality of sensors for receiving in situ operating parameter information from the chiller or cooler, wherein at least one of the plurality of sensors measures an operating parameter of a liquid temperature of a liquid being cooled, and another of the plurality of sensors measures an operating parameter of a fan within the chiller or cooler, a controller further generating a self test signal to the chiller to change a set point of temperature of the chiller a preselected amount, the controller further connected to the at least one of the plurality of sensors measuring an operating parameter of the liquid temperature of the liquid being cooled to determine a self test cooling rate for the chiller to obtain the change in the set point of temperature, the controller further calculating an expected self test cooling rate using the ambient air temperature and a factory self test cooling rate stored in a memory, and the controller further comparing the self test cooling rate and the expected self test cooling rate;

d) the memory for storing at least one fixed preset operating limit programmed into the memory related to the operation of the chiller or cooler; and e) the controller connected to the memory and the at least one sensor of the plurality of sensors for automatically engaging the spindle to move the filter sheet so as to shift a portion of the filter sheet operatively engaging the condenser intake surface in response to both of: i) the at least one sensor of the plurality of sensors input from the chiller or cooler that exceeds the fixed preset operating limit, and ii) the self test cooling rate and the expected self test cooling rate deviate by more than a preselected threshold.

9. The system of claim 8, wherein the at least one sensor of the plurality of sensors detects compressor inlet airflow.

10. The system of claim 8, wherein the at least one sensor of the plurality of sensors detects fan current.

11. The system of claim 8, wherein the at least one sensor of the plurality of sensors detects discharge temperature.

12. The system of claim 8, wherein the at least one sensor of the plurality of sensors detects fan RPM.

* * * * *